US006822548B2

(12) United States Patent
Wang et al.

(10) Patent No.: US 6,822,548 B2
(45) Date of Patent: Nov. 23, 2004

(54) MAGNETIC THIN FILM INDUCTORS

(75) Inventors: Xingwu Wang, Wellsville, NY (US); Chungsheng Yang, Almond, NY (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 10/786,533

(22) Filed: Feb. 25, 2004

(65) Prior Publication Data

US 2004/0164836 A1 Aug. 26, 2004

Related U.S. Application Data

(62) Division of application No. 10/014,045, filed on Dec. 11, 2001, now Pat. No. 6,700,472.

(51) Int. Cl.[7] ..... H01F 5/00
(52) U.S. Cl. ..... 336/200; 336/232; 336/223
(58) Field of Search ..... 336/200, 223, 336/232; 29/602.1

(56) References Cited

U.S. PATENT DOCUMENTS

| | | | |
|---|---|---|---|
| 5,370,766 A | 12/1994 | Desaigoudar et al. | |
| 5,450,263 A | 9/1995 | Desaigoudar et al. | |
| 5,609,946 A | 3/1997 | Korman et al. | |
| 5,635,892 A | 6/1997 | Ashby et al. | |
| 5,793,272 A | 8/1998 | Burghartz et al. | |
| 5,847,634 A | 12/1998 | Korenivski et al. | |
| 5,884,990 A | 3/1999 | Burghartz et al. | |
| 5,959,522 A | 9/1999 | Andrews | |
| 5,966,063 A | 10/1999 | Sato et al. | |
| 6,054,329 A | 4/2000 | Burghartz et al. | |
| 6,114,937 A | 9/2000 | Burghartz et al. | |
| 6,140,902 A | 10/2000 | Yamasawa et al. | |
| 6,175,293 B1 | 1/2001 | Hasegawa et al. | |
| 6,207,303 B1 | 3/2001 | Tomita | |
| 6,239,683 B1 * | 5/2001 | Roessler et al. | 336/200 |
| 6,262,649 B1 * | 7/2001 | Roessler et al. | 336/65 |
| 6,489,876 B1 * | 12/2002 | Jitaru | 336/200 |

OTHER PUBLICATIONS

G.G. Bush, The complex permeability of a high purity yttrium iron garnet (YIG) sputtered thin film, J. Appl. Phys. vol. 73, pp. 6310–6311(1993).

M. DeMarco, et al., Mossbauer and magnetization studies of nickel ferrites, J. Appl. Phys. vol. 73 pp. 6287–6290 (1993).

S. Jin et al., High frequency properties of Fe–Cr–Ta–N soft magnetic films, Appl. Phys. Lett., vol. 70, pp. 3161–3163(1997).

V. Korenivski, and R.B. van Dover, Magnetic film inductors for radio frequency applications, J. Appl. Phys., vol. 82, pp. 5247–5254 (1997).

M. Senda, et al., High frequency measurement technique for patterned soft magnetic film permeability with magnetic film/conductor/magnetic film inductance line. Rev. Sci. Instrum., vol. 64, pp. 1034–1037 (1993).

(List continued on next page.)

*Primary Examiner*—Anh Mai
(74) *Attorney, Agent, or Firm*—Fogg and Associates, LLC; Scott V. Lundberg

(57) ABSTRACT

The present invention relates to inductors with improved inductance and quality factor. In one embodiment, a magnetic thin film inductor is disclosed. In this embodiment, magnetic thin film inductor includes a plurality of elongated conducting regions and magnetic material. The plurality of elongated conducting regions are positioned parallel with each other and at a predetermined spaced distance apart from each other. The magnetic material encases the plurality of conducting regions, wherein when currents are applied to the conductors, current paths in each of the conductors cause the currents to generally flow in the same direction thereby enhancing mutual inductance.

11 Claims, 7 Drawing Sheets

OTHER PUBLICATIONS

M. Yamaguchi, et al., Characteristics and analysis of a thin film inductor with closed magnetic circuit structure, IEEE Trans. Magnetics, vol. 28, pp. 3015–3017 (1992).

M. Yamaguchi, et al., Magnetic RF integrated thin–film inductors, IEEE MTT–S International Microwave Symposium Digest, vol. 1, pp. 205–208 (2000).

M. Yamaguchi et al., Microfabrication and characteristics of magnetic thin–film inductors in the ultrahigh frequency region, J. Appl. Phys., vol. 85, pp. 7919–7922 (1999).

S.X. Wang, et al., Properties of a new soft magnetic material, Nature, vol. 407, pp. 150–151 (2000).

* cited by examiner

MAGNETIC THIN FILM INDUCTORS

CROSS REFERENCE TO RELATED CASES

This application is a divisional application of U.S. application Ser. No. 10/014,045, entitled "Magnetic Thin Film Inductors," filed Dec. 11, 2001 now U.S. Pat. No. 6,700,472.

TECHNICAL FIELD

The present invention relates generally to magnetic thin film inductors and in particular the present invention relates to magnetic thin film inductors with improved inductance and quality factor at relatively high frequencies.

BACKGROUND

Inductors used in integrated circuits are typically mounted on a substrate of the integrated circuit. An inductor typically comprises conducting material formed in a straight line or spiral shape with magnetic material positioned in close proximity. This type of inductor is typically used in relatively low frequency applications, about 1 giga hertz (GHz) or less. At about 1 GHz, the magnetic material of the prior art typically reaches ferro-magnetic resonance. Inductors operating near and/or beyond their ferro-magnetic resonance frequencies will have poor inductance performance. In particular, they will have a poor quality factor due to relatively high eddy currents and interference. Moreover, existing inductors generally take up a relatively large amount of space. In wireless communication operations, it is desired to have an inductor that is relatively small and can operate at a frequency above 1 giga hertz. Accordingly, it is desired in the art for an inductor design that can operate at a relatively high frequency with high inductance while taking up a relatively small amount of space.

For the reasons stated above and for other reasons stated below which will become apparent to those skilled in the art upon reading and understanding the present specification, there is a need in the art for an efficient inductor that can operate at relatively high frequencies.

SUMMARY

The above-mentioned problems with existing inductors and other problems are addressed by the present invention and will be understood by reading and studying the following specification.

In one embodiment, a magnetic thin film inductor is disclosed. The magnetic thin film inductor includes a plurality of elongated conducting regions and magnetic material. The plurality of elongated conducting regions are positioned parallel with each other and at a selected spaced distance apart from each other. The magnetic material encases the plurality of conducting regions, wherein when currents are applied to the conducting regions, current paths in each of the conducting regions cause the currents to generally flow in the same direction thereby enhancing mutual inductance.

In another embodiment, a magnetic thin film inductor is disclosed that comprises a conducting member having one or more turns and portions of magnetic material. The portions of magnetic material encase the one or more turns of the conducting member. Moreover, each portion of magnetic material encases portions of the one or more turns that conduct current in a substantially uniform direction.

In another embodiment, a magnetic thin film inductor comprises a conductive member and magnetic material. The conductive member is formed into one or more coils. The magnetic material is formed to encase the one or more coils. The magnetic material has a central opening. The one or more coils extend around the central opening. The magnetic material further has a plurality of gaps.

In another embodiment, a method of forming a magnetic thin film inductor is disclosed. The method comprises forming a first layer of magnetic material on a substrate. Forming a layer of conducting material overlaying the first layer of magnetic material. Patterning the conductive layer to form two or more generally parallel conducting members, wherein the two or more conductive members are positioned proximate each other. Forming a second layer of magnetic material overlaying the conductive members and portions of the first layer of magnetic material, wherein the conductive members are encased by the first and second layers of magnetic material.

In another embodiment, a method of forming a magnetic thin film inductor is disclosed. The method comprises forming a first layer of magnetic material on a substrate, forming a layer of conductive material overlaying the first layer of magnetic material and patterning the conductive material to form one or more turns of a conductive member in a predefined shape. Forming a second layer of magnetic material overlaying the one or more turns of the conductive member and the first layer of magnetic material. Removing portions of the first and second layers of magnetic material to form a central opening to the substrate, wherein the first and second layers of magnetic material encase the one or more conducting members that extend around the central opening.

In another embodiment, a method of operating a magnetic thin film inductor in an integrated circuit is disclosed. The method comprises coupling a current to a plurality of conducting members positioned generally parallel with each other and encased by sections of magnetic material, wherein each section of magnetic material encases a plurality of conducting members in which current is flowing in generally the same direction.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to embodiments of the present invention. Reference characters denote like elements throughout figures and text.

DETAILED DESCRIPTION

In the following detailed description of the preferred embodiments, reference is made to the accompanying drawings, which form a part hereof, and in which are shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention relates to embodiments of a magnetic thin film inductors with improved inductance and quality factor. In the following description, the term substrate is used to refer generally to any structure on which integrated circuits are formed, and also to such structures during various stages of integrated circuit fabrication. This term includes doped and undoped semiconductors, epitaxial layers of a semiconductor on a supporting semiconductor or insulating material, combinations of such layers, as well as other such structures that are known in the art. Terms of relative position as used in this application are defined based on a plane parallel to the conventional plane or working surface of a wafer or substrate, regardless of the orientation of the wafer or substrate. Terms, such as "on", "side", "higher", "lower", "over," "top" and "under" are defined with respect to the conventional plane or working surface being on the top surface of the wafer or substrate, regardless of the orientation of the wafer or substrate.

Figures 1, 2:
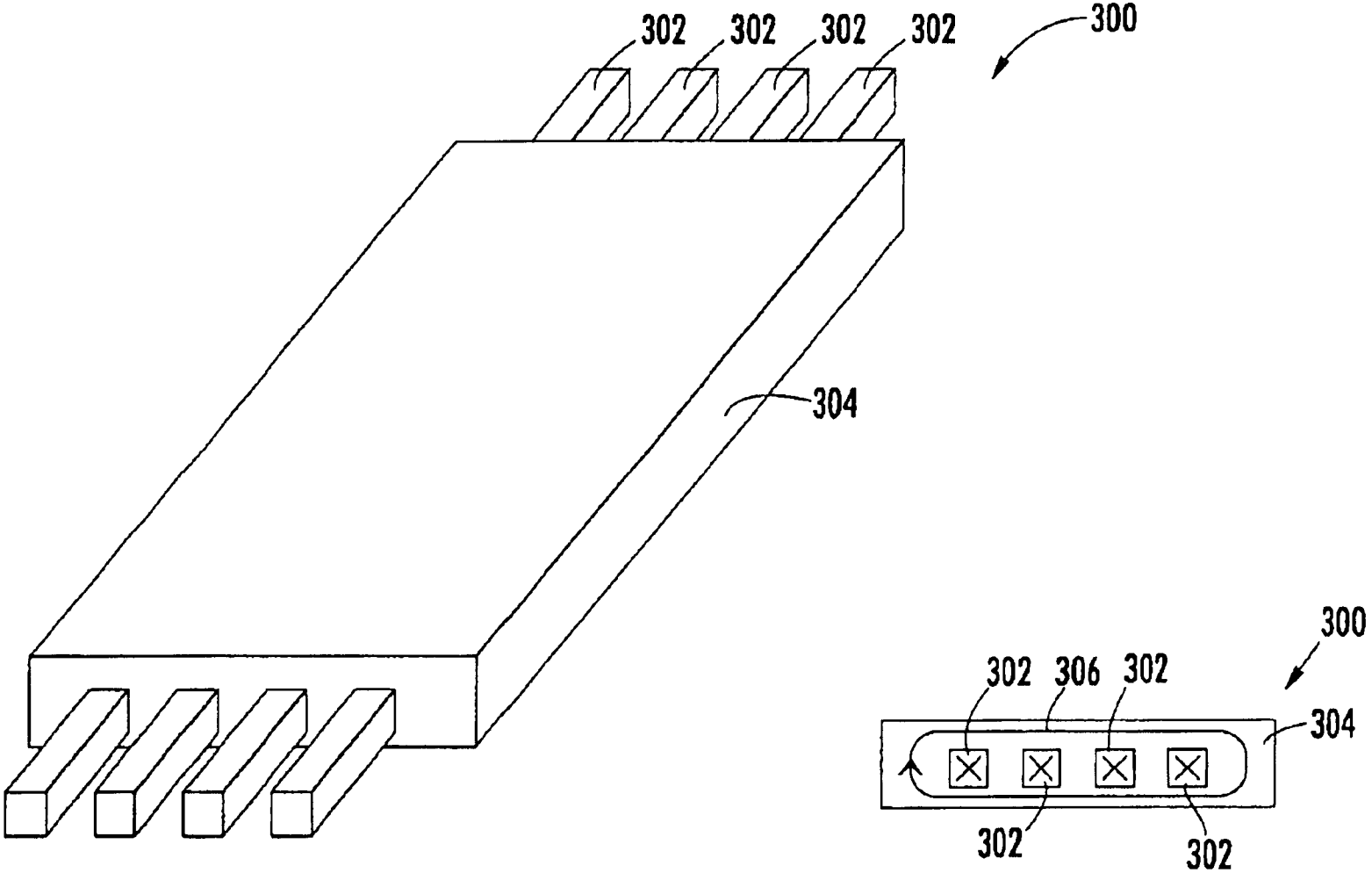
FIG. 1 is a perspective view of one embodiment of the present invention.
FIG. 2 is a cross-sectional view of one embodiment of the present invention.

An embodiment of a thin film inductor 300 of the present invention is illustrated in FIG. 1. In this embodiment, elongate conducting members 302 (which are positioned parallel with each other and are a selected distance apart from each other) are encased with a magnetic material 304. In operation each of the conducting members conduct current in the same direction. The magnetic flux 306 created in the magnetic material 304 in response to the currents is illustrated in FIG. 2. FIG. 2 is a cross-sectional illustration of thin film inductor 300. In particular, FIG. 2 illustrates the current flowing into each of the conducting members 302 and a line of magnetic flux 306 created in response to the currents. In this embodiment, a magnetic flux line created by one of the conducting members 302 combines with the magnetic flux lines of adjacent conducting members 302 to enhance the mutual inductance of the magnetic thin film inductor 300.

Figure 4:
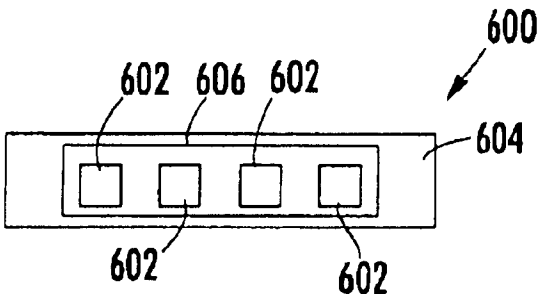
FIG. 4 is a cross-sectional view of one embodiment of the present invention.
Figure 3:
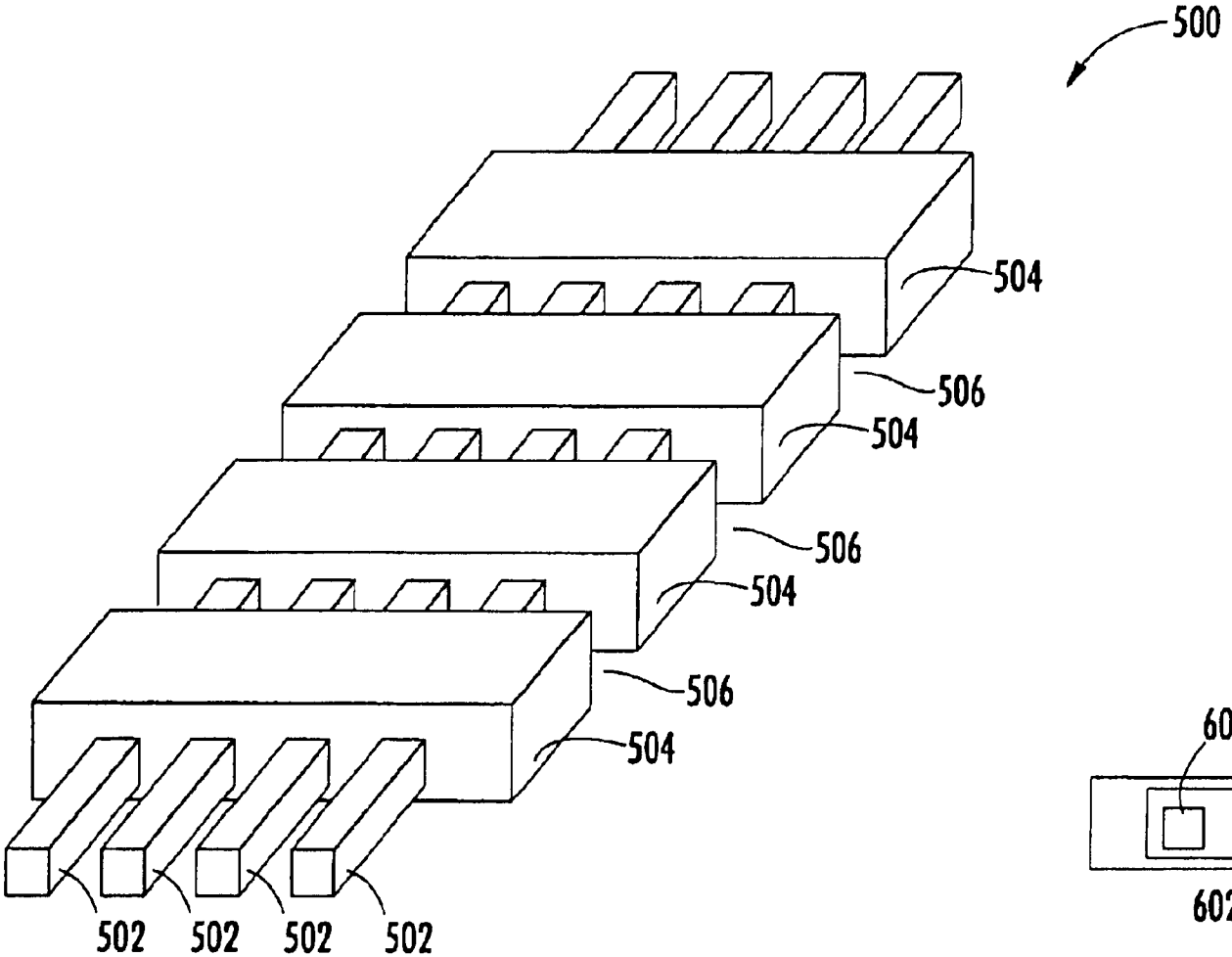
FIG. 3 is a perspective view of one embodiment of the present invention.
Figure 5G:
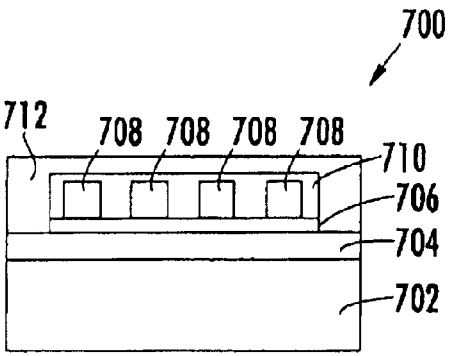
FIGS. 5A-5G are cross-sectional views illustrating the formation of one embodiment of the present invention.
Figure 5D:
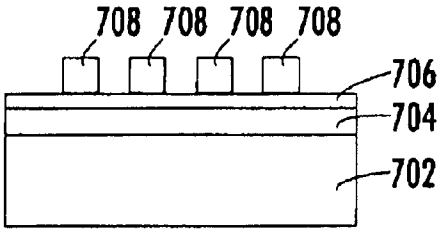
Figure 5E:
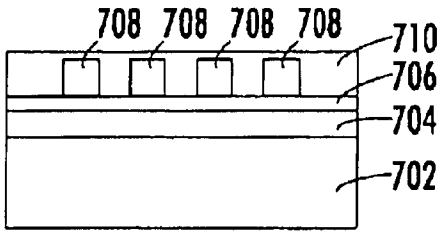
Figure 5F:
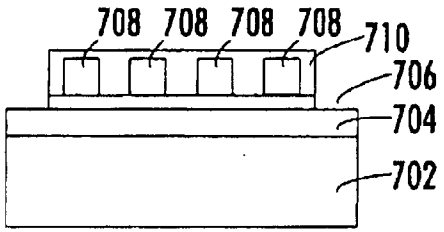
Figure 5A:
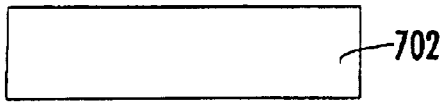
Figure 5B:
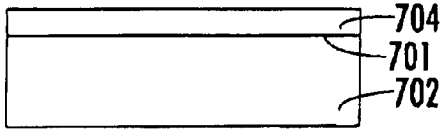
Figure 5C:
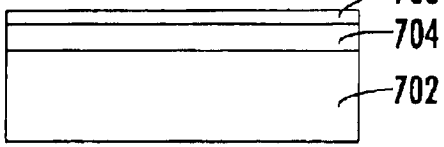

Another embodiment of a thin film inductor 500 is illustrated in FIG. 3. This embodiment includes conducting members 502 and a magnetic material 504 encasing the conducting members 502. The magnetic material 504 has gaps 506 (or cutout sections 506) that form sections of magnetic material 504. The gaps reduce eddy currents in the magnetic material 504. As illustrated, the gaps 506 are positioned generally perpendicular to the path of the conducting members 502. Stated another way, the conducting members enter and exit each gap generally perpendicular to edges of the sectioned magnetic material 504. As in the previous embodiment, the currents flowing in the same direction in the conducting members 502 creates magnetic flux lines that enhance the mutual inductance of the magnetic thin film inductor 500. In another embodiment of the thin film inductor 600, a layer of insulator 606 (or dielectric 606) is positioned between conducting members 602 and an encasing magnetic material 604. This is illustrated in the cross-section view of FIG. 4. In one embodiment, silicon dioxide is used as the insulator. Although, adding the insulting layer 606 slightly decreases inductance, eddy current loss will also decrease and the overall quality factor of the magnetic thin film inductor 600 will be increased.

One method of forming a magnetic thin film inductor 700 is illustrated in FIGS. 5(A-G). Referring to FIG. 5A, this method starts with a clean substrate 702 (silicon oxide or silicon). A first layer of magnetic material 704 is deposited on a working surface 701 of the substrate 702 as illustrated in FIG. 5B. Next a first insulation layer 706 is deposited overlaying the first layer of magnetic material 704. This is illustrated in FIG. 5C. A conductive layer is then formed overlaying the first insulation layer 706. The conductive layer is patterned to form the conductive members 708. This is illustrated in FIG. 5D. In one embodiment, the conductive members 708 is shaped by masking, deposition, and/or etching. Referring to FIG. 5E, a second insulting layer 710 is deposited overlaying the conductive members 708 and portions of the first insulation layer 706. Portions of second insulation layer 710 and the first insulation layer 706 are etched away as illustrated in FIG. 5F. A second layer of magnetic material 712 is then deposited overlaying the second insulation layer 710 and portions of the first layer of magnetic material 704. This forms magnetic thin film inductor 700 of FIG. 5G. In addition, the first and second layers of magnetic film 704 and 712 can be a single layer of a magnetic material (as illustrated above) or a multi-layer structure with at least two different types of magnetic material. These magnetic materials are stacked alternatively to achieve the optimized effect.

Figure 6:
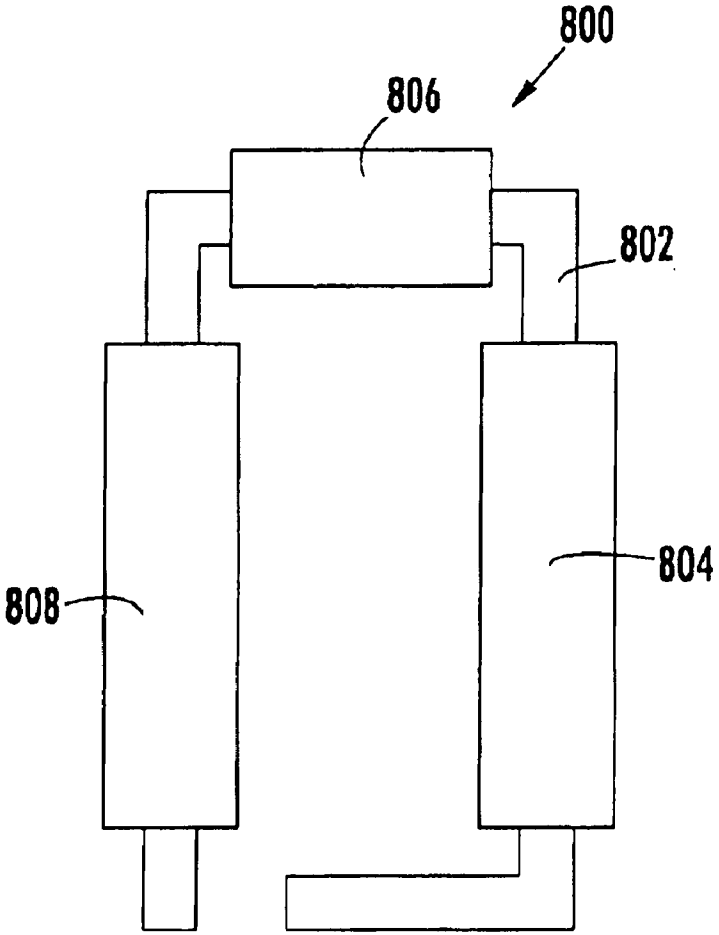
FIG. 6 is a top view of one embodiment of a rectangular inductor of the present invention.

As stated above, embodiments of the present invention are applied to inductive devices wherein currents are flowing in relatively straight conducting paths and wherein the conducting material that makes up the conducting paths are encased with magnetic material. However, embodiments of the present invention can also be applied to spiral inductors of different shapes. For example, referring to FIG. 6, an embodiment of a rectangular spiral inductor 800 of the present invention is illustrated. As illustrated, this embodiment includes conducting member 802 formed in the shape of a rectangle. The conducting member 802 is encased with sections of magnetic material 804, 806, 808. As illustrated, each section of magnetic material 804, 806 and 808 encases a portion of the conducting member in which the current travels in a substantially uniform direction. Moreover, as illustrated, corner portions (portions that curve or bend) of the conducting member 802 are not encased with magnetic material. This significantly reduces the loss due to eddy currents.

Figure 7:
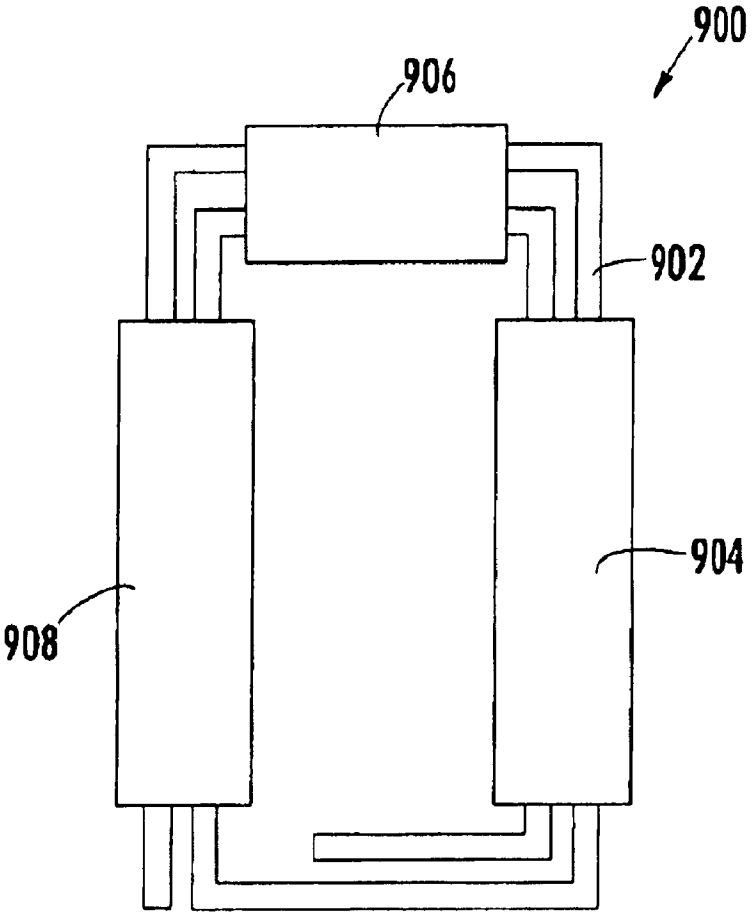
FIG. 7 is a top view of another embodiment of a rectangular inductor of the present invention.
Figure 8:
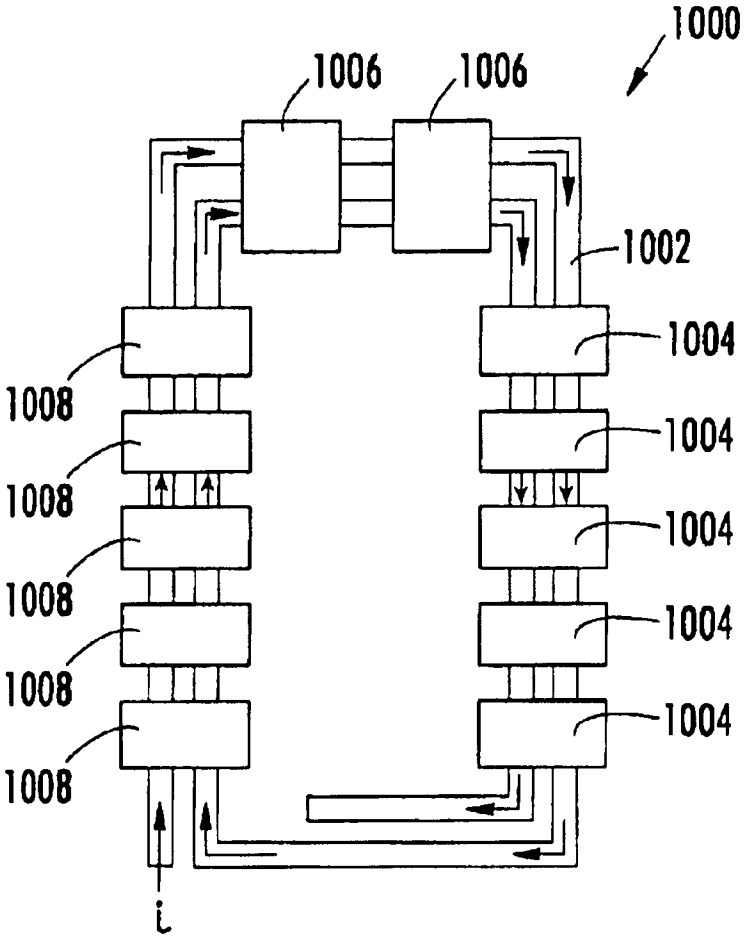
FIG. 8 is a top view of yet another embodiment of a rectangular inductor of the present invention.

Another embodiment of a spiral rectangular inductor 900 is illustrated in FIG. 7. In this embodiment, the conducting material 902 is formed in a spiral of two paths (two turns or two coils) with sections of magnetic material 904, 906 and 908 selectively positioned. Each magnetic material section 904, 906 and 908 is encased around portions of the conducting member 902 wherein current flows in the same direction. Although, FIG. 7 only shows the conducting member as being formed in two turns, it will be understood that more than two turns could be formed depending on the amount of inductance desired and that the present invention is not limited to two turns. In another embodiment of a spiral rectangular inductor 1000, sections of magnetic material 1004, 1006 and 1008 are further partitioned into smaller sections. This is illustrated in FIG. 8. By further sectioning the magnetic material 1004, 1006 and 1008 eddy currents are further reduced. As illustrated in FIG. 8, the conductors 1002 provide substantially parallel current paths in which current (i) flows in substantially uniform directions where the conductors are encased by the sections of magnetic material 1004, 1006 and 1008.

Figure 9:
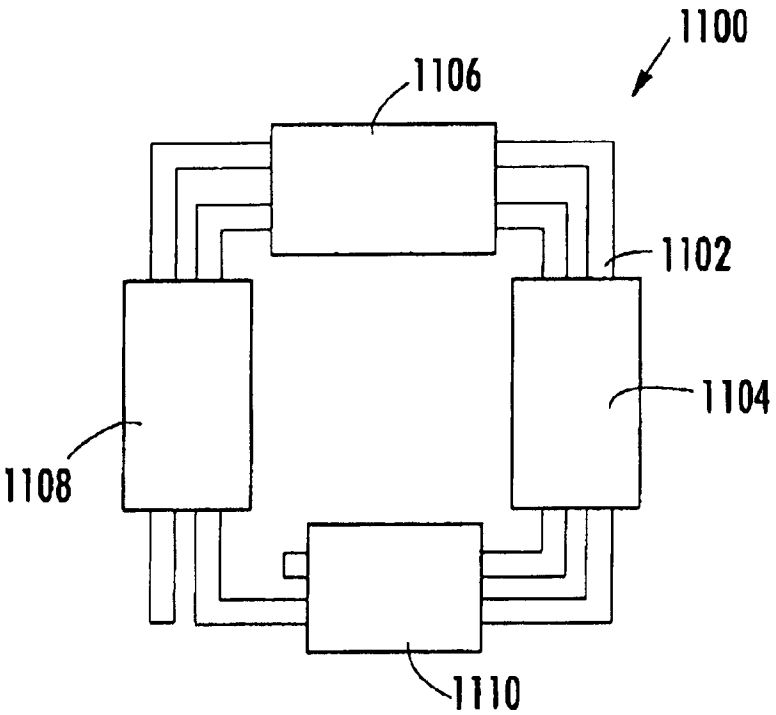
FIG. 9 is a top view of one embodiment of a square coil inductor of the present invention.

Referring to FIG. 9, a square spiral inductor 1100 of one embodiment of the present invention is disclosed. This embodiment includes a conducting member 1102 having two turns and four sections of magnetic material 1104, 1106, 1108 and 1110 encasing relatively parallel sections of the conducting member 1102. Although not shown, the sections of magnetic material 1104, 1106, 1108 and 1110 can each be further sectioned to further reduce the eddy currents, similar to what was illustrated in FIG. 8. Moreover, the number of turns can vary to achieve a desired inductance.

Figure 11:
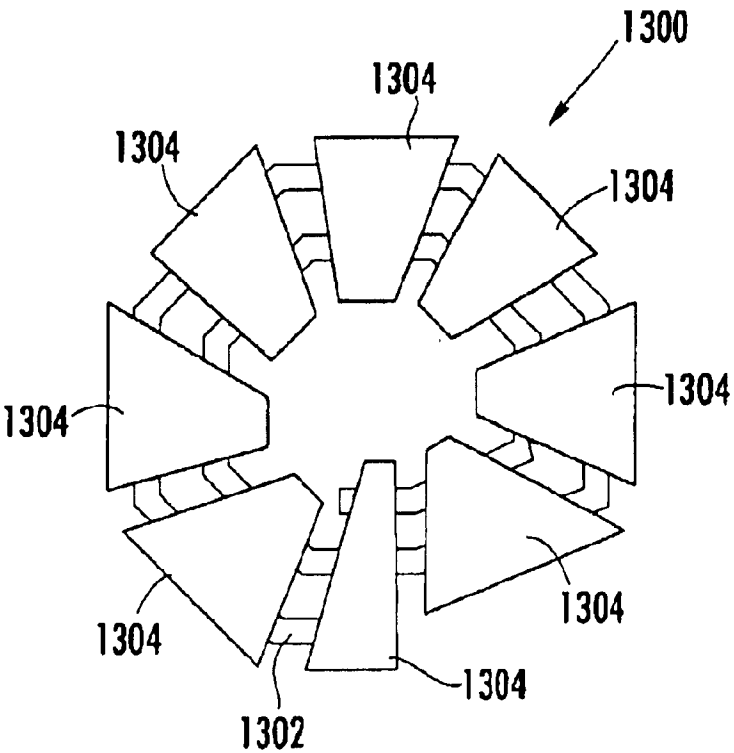
FIG. 11 is a top view of an embodiment of an octagonal inductor of the present invention.
Figure 10:
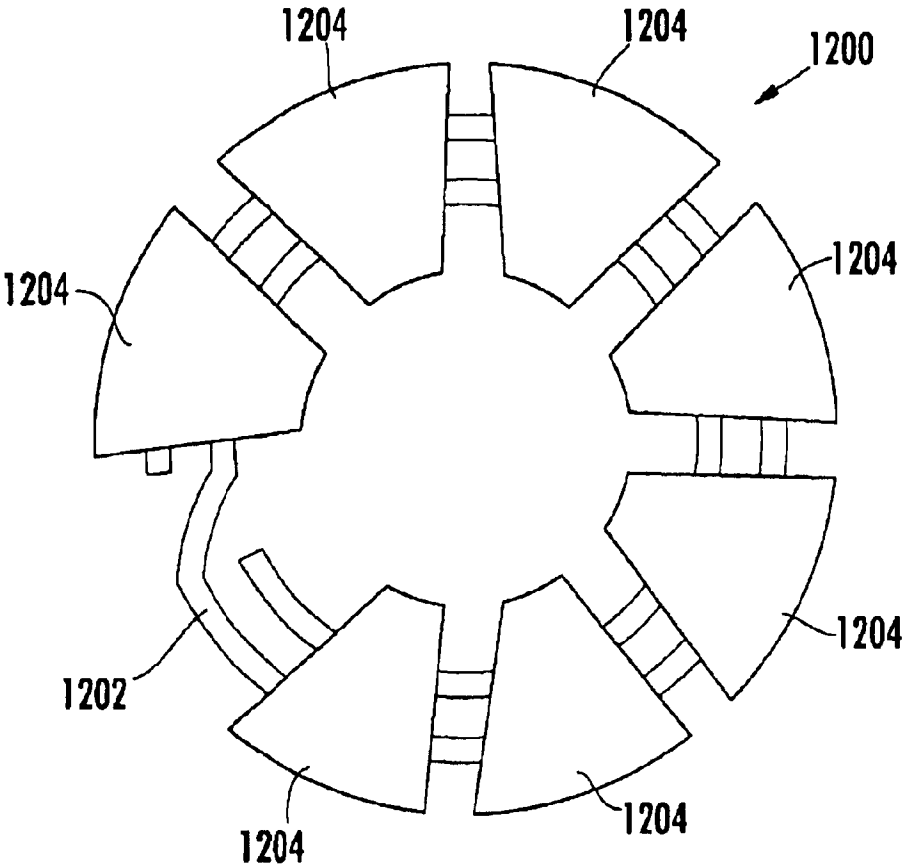
FIG. 10 is a top view of an embodiment of a circular coil inductor of the present invention.

The embodiments of the present invention can also be applied to other shapes. For example, a circular embodiment of a spiral inductor 1200 is illustrated in FIG. 10. In this embodiment, pie shaped sections of magnetic material 1204 selectively encase conductive member 1202. As with the other embodiments of the present inventions, in this embodiment each section of magnetic material 1204 encases a section of the conductive member 1202 wherein current is flowing in a substantially uniform direction. Another example of an embodiment of an inductor 1300 is an octagon shape as illustrated in FIG. 11. In this embodiment, pie shaped sections of magnetic material 1304 selectively encase sections of conductive member 1302.

Figure 12:
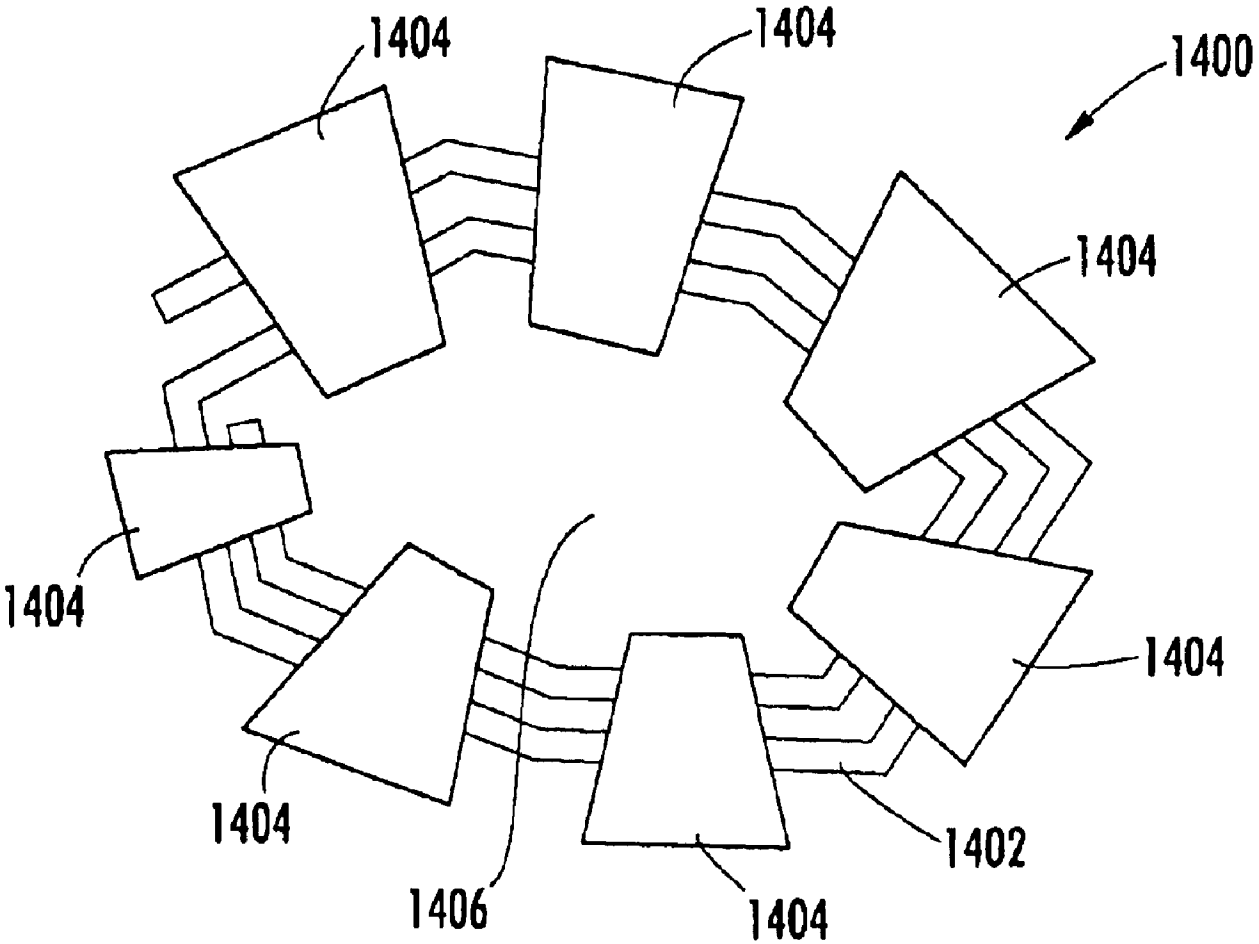
FIG. 12 is a top view of one embodiment of an arbitrary shaped coil inductor of the present invention.

Moreover, the present invention can be applied to other shapes including generally regular polygonal shapes such as square, octagonal, hexagonal and circular. In addition, embodiments of the present invention can be applied to arbitrary shapes. For example, referring to FIG. 12, yet another embodiment of an inductor 1400 of the present invention is illustrated. In this embodiment, sections of magnetic material 1404 are selectively positioned to encase sections of conducting member 1402 that are positioned in an arbitrary shape. As with the previous embodiments of the present invention, each magnetic material section 1404 is selectively placed so it encases sections of the conducting member 1400 wherein current in the conducting member 1402 travels in a substantially uniform direction. Moreover, as with the previous embodiments, edges of each section of the magnetic material in which the conducting member 1402 enters and exits are generally perpendicular to a path of the conducting member 1402.

In forming embodiments of the present invention, layers of magnetic material are first deposited and then patterned to encase selected portions of the conducting members. In each of the embodiments of an inductor in a spiral formation, a central opening in the layers of magnetic material is formed. This is illustrated in FIGS. 6-12. For example, the conducting member 1402 of FIG. 12 encircles the central opening 1406. This design allows each section of magnetic material 1404 to encase only a portion of the conducting member 1402 in which current is flowing in relatively the same direction.

The embodiments of the present invention as illustrated in FIGS. 1-12 can employ different types of magnetic material. For example, embodiments of the present invention use soft magnetic materials such as FeNi, FeSiAI and CoNbZr. However, inductors with relatively high ferromagnetic frequency can be achieved in the embodiments of the present invention using magnetic thin films having nano particles that form high resisitivity. Examples of magnetic thin films with high resistivity are FeBN, FeBO, FeBC, FeCoBF, FeSiO, FeHfO, FeCoSiBO, FeSmO, FeAlBO, FeSmBO, FeCoSmO, FeZrO, FeNdO, FeYO, FeMgO, CoFeHfO, CoFeSiN, CoAlO, CoAlPdO, CoFeAlO, CoYO, FeAlO and CoFeBSiO. A typical magnetic film thickness for the present invention is around 0.1 to 1.5 micrometers and a typical insulator thickness is about 1 micrometer. As stated above, some embodiments of the present invention use a combination of layers of different magnetic material to form a finished magnetic layer having desired properties.

In addition, embodiments of the present invention use nano particles of Fe that are introduced into a matrix of $Al_2O_3$ to form the magnetic material. The nano particles create higher resistivity which helps to reduce eddy currents. Moreover, with the use of the FeAlO, experiments have shown a ferromagnetic resonance frequency of approximately 9.5 GHz for a thin film thickness (the thickness of the magnetic material) of about 0.15 micometers can be achieved. In addition, the total length of the spiral embodiments is approximately 1 mm. The ferromagnetic resonance frequency of this embodiment as well as the physical length of this embodiment is within the range desired for wireless communication applications.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A magnetic thin film inductor comprising:

a plurality of elongated conducting regions positioned parallel with each other and at a selected spaced distance apart from each other; and magnetic material encasing the plurality of conducting regions, wherein when currents are applied to the conducting regions, current paths in each of the conducting regions cause the currents to generally flow in the same direction to enhance mutual inductance.

2. The magnetic thin film inductor of claim 1, wherein the magnetic material further has cutout sections to reduce eddy currents.

3. The magnetic thin film inductor of claim 1, further comprising:

an insulating layer for each conducting region, the insulating layer is positioned between an associated conducting region and the magnetic material.

4. The magnetic thin film inductor of claim 1, wherein the magnetic material is made from layers of different magnetic material.

5. The magnetic thin film inductor of claim 1, wherein the magnetic material is made from the group consisting of, FeAlO, FeBN, FeBO, FeBC, FeCoBF, FeSiO, FeHfO, FeCoSiBO, FeSmO, FeAlBO, FeSmBO, FeCoSmBO, FeZrO, FeNdO, FeYO, FeMgO, CoFeHfO, CoFeSiN, CoAlO, CoAlPdO, CoFeAlO, CoYO and CoFeBSiO.

6. The magnetic thin film inductor of claim 5, wherein the thickness of the magnetic material is in a range of about 0.1 to 1.5 micrometers.

7. A magnetic film inductor comprising:

two or more conductive member positioned parallel to each other;

magnetic material encasing the two or more conductive members along at least one relatively straight path of the two or more conductive members, wherein current flowing through the two or more conductive members in the same direction enhance mutual inductance of the magnetic film inductor.

8. The magnetic film of claim 7, wherein the magnetic material along at least one relatively straight path has at least one cutout section to prevent eddy currents.

9. The magnetic film of claim 7, further comprising:

an insulating layer formed between each conducting member and the magnetic material.

10. The magnetic film of claim 7, wherein the magnetic material is made from the group consisting of, FeAlO, FeBN, FeBO, FeBC, FeCoBF, FeSiO, FeHfO, FeCoSiBO, FeSmO, FeAlBO, FeSmBO, FeCoSmO, FeZrO, FeNdO, FeYO, FeMgO, CoFeHfO, CoFeSiN, CoAlO, CoAlPdO, CoFeAlO, CoYO and CoFeBSiO.

11. The magnetic thin film inductor of claim 10, wherein the thickness of the magnetic material is in a range of about 0.1 to 1.5 micrometers.

* * * * *

UNITED STATES PATENT AND TRADEMARK OFFICE

CERTIFICATE OF CORRECTION

PATENT NO. : 6,822,548 B2
APPLICATION NO. : 10/786533
DATED : November 23, 2004
INVENTOR(S) : Wang et al.

It is certified that error appears in the above-identified patent and that said Letters Patent is hereby corrected as shown below:

At claim 5, column 6, line 65, please replace the first occurrence of "FeCoSmBO" with --FeCoSmO--

Signed and Sealed this

Twenty Second Day of April, 2008

JON W. DUDAS
*Director of the United States Patent and Trademark Office*